US006722818B1

(12) United States Patent
Suazo et al.

(10) Patent No.: US 6,722,818 B1
(45) Date of Patent: Apr. 20, 2004

(54) DITCH LINER SYSTEM

(75) Inventors: Kenneth L. Suazo, Vallecitos, NM (US); Isaac Suazo, Vallecitos, NM (US)

(73) Assignee: Fast Ditch, Inc., Vallecitos, NM (US)

( * ) Notice: Subject to any disclaimer, the term of this patent is extended or adjusted under 35 U.S.C. 154(b) by 0 days.

(21) Appl. No.: 10/453,673

(22) Filed: Jun. 3, 2003

Related U.S. Application Data

(63) Continuation-in-part of application No. 10/316,756, filed on Dec. 11, 2002.

(51) Int. Cl.[7] ..... E02B 13/00; E02B 5/02
(52) U.S. Cl. ..... 405/121; 405/118; 405/270
(58) Field of Search ..... 405/118, 119, 405/120, 121, 268, 270, 49, 46

(56) References Cited

U.S. PATENT DOCUMENTS 980,442 A * 1/1911 Schlafly ..... 405/49
2,582,515 A * 1/1952 Warp ..... 405/40
3,156,099 A * 11/1964 Dailey ..... 405/121
3,854,292 A * 12/1974 Nienstadt ..... 405/270
3,878,685 A * 4/1975 Schmunk ..... 405/49
3,897,090 A * 7/1975 Maroschak ..... 405/49
3,926,222 A * 12/1975 Shroy et al. ..... 405/49
3,958,425 A * 5/1976 Maroschak ..... 405/49
5,669,733 A * 9/1997 Daly et al. ..... 405/46
6,273,640 B1 * 8/2001 Suazo ..... 405/121

* cited by examiner

*Primary Examiner*—Frederick L. Lagman
(74) *Attorney, Agent, or Firm*—Ray R. Regan

(57) ABSTRACT

A ditch liner system is provided. The ditch liner system includes a plurality of removably engageable corrugated ditch liners. Each of the removably engageable corrugated ditch liners is monolithically formed with a compressibly connectable member at one end, and a coupling channel at the other end. The compressibly connectable member, and the coupling channel, are reciprocally and compressibly connectable. A duct is formed in the compressibly connectable member for insertion of a sealant. A groove is formed in the coupling channel for inserting one or more connectors. An adapter is provided for directing water from the ditch.

26 Claims, 8 Drawing Sheets

DITCH LINER SYSTEM

CROSS-REFERENCE TO RELATED APPLICATION

This application is a continuation-in-part of co-pending non-provisional U.S. patent application Ser. No. 10/316,756, filed on Dec. 11, 2002.

FIELD OF THE INVENTION

The present invention pertains generally to transportation of water. More particularly, the new and useful invention claimed in this document pertains to a ditch liner system for conveying water through irrigation ditches. The present invention is particularly, but not exclusively, useful for providing both an apparatus and method for conveying water through concrete lined earthen ditches. The present invention also is useful for directing water flow into other ditches, from interconnected ditch liner sections. The present invention is also useful for reducing water loss during transportation of water through the system of ditch liners practiced in accordance with the present invention. The present invention also is useful for routing water by inverting a series of the ditch liners.

BACKGROUND OF THE INVENTION

Ditches formed in earth for conveying water to a point or area of use have been common for generations throughout the world. Ditches have been used to transport both potable and irrigation water. Earthen irrigation ditches continue to be significant transporters of water, particularly to convey surface irrigation water to crops. As used in this document, the term "ditch" includes any excavation dug in the earth that also may be referred to as a drain, channel, canal or acequia. Earthen ditches, relying on principles of gravity flow to transport water along descending elevations of a ditch, continue to be popular because they provide low-cost irrigation systems.

Since the advent of concrete and other building materials made by mixing a cementing material such as Portland cement with both a mineral aggregate such as sand and gravel, and sufficient water to cause the cementing material to set and bind the entire mass, concrete and similar materials have been used to line earthen ditches. A purpose of concrete lined ditches was to avoid loss of water through seepage into the earth. As use of concrete and similar materials increased, it became common to shape the cross-section of earthen ditches in a substantially trapezoidal configuration. Accordingly, the concrete used to line earthen ditches tends to be trapezoidal in cross-section as well.

Concrete, however, has several limitations and deficiencies as a liner for earthen ditches. Material characteristics of concrete are not consistent, and usually are not even consistent within the same ditch. Concrete ditch liners also react adversely to changes in ambient temperatures, and to rapidly altering hot and cold cycles. Concrete is subject to cracking due to temperature changes. If moisture penetrates cracks in concrete, a concrete lined ditch is subject to further cracking. Slight cracks have a tendency to expand into large cracks as frost and thaw cycles proceed through a typical year. In the end, concrete lined ditches are subject to possible catastrophic failure. As a result, significant amounts of water may be lost when transported through concrete lined ditches. The significant quantities of lost water, which is becoming an ever more precious commodity, are lost because of seepage, erosion, trans-evaporation and other causes.

However, concrete lines ditches are peculiarly susceptible to cracking, decomposition, and the ultimate loss of significant amounts of water due to seepage through cracked concrete lined ditches.

Additional limitations of concrete lined ditches are significant. Not only are large quantities of water lost through seepage caused by cracks, breaks, and other forms of deterioration in concrete lined ditches, but concrete lined ditches must constantly be maintained, cleaned and repaired to avoid further loss of water through wall collapse, accumulated debris, newly formed cracks and deterioration of the base and walls of concrete due to the continued effects of weather. Repair and maintenance of concrete lined ditches is costly and labor intensive. Patching concrete is expensive, labor intensive, and difficult to achieve given the remote location of most ditches, particularly agricultural ditches used to transport irrigation water. The repair problems associated with concrete lined ditches present major construction efforts that often are neither practical nor affordable. Therefore, many concrete ditches continue to deteriorate, resulting in increased loss of water. Inability to readily direct and redirect water flow to other ditches or in other directions using concrete or steel also is a significant limitation on their use.

In recent years, efforts have been made to develop ways and means to seal cracked concrete lined ditches. For example, a variety of mortars and sprayed-on resins and plastics have been suggested. Unfortunately, both mortar and spray-on resins and plastics have proven to be inadequate solutions because of the costs involved in the materials and applications processes, and because of labor costs associated with direct application of such materials at the site of a concrete lined ditch, regular often remote from where such materials are available.

Concrete is expensive to install. Although concrete appears to be substantially permanent, as indicated, it is subject to deterioration. Removing a cracked concrete ditch liner is inordinately expensive, time consuming, and labor intensive.

What is needed, therefore, is an insert that can be placed into a concrete lined ditch that is easily installed, without heavy equipment, and is cost effective. What also is needed is a ditch liner system that may be inserted into a concrete lined ditch regardless of the extent of cracks, disintegration or other deterioration in a concrete ditch, and that directs water with minimal water loss through the ditch liner system.

An exemplary solution to problems associated with lining earthen ditches was provided by one of the present inventors in U.S. Pat. No. 6,273,640 B1, issued to Kenneth L. Suazo on Aug. 14, 2001 ("Suazo Patent"). The Suazo Patent provided an irrigation ditch liner system comprising a plurality of liner sections that are semi-cylindrical in shape and employ a sem-cylindrical connector piece to connect liner sections along the course of a ditch. Another exemplary solution to problems associated with lining earthen ditches is provided in U.S. patent application Ser. No. 10/316,756 filed by two of the present inventors on Dec. 11, 2002, for An Apparatus And Method For Transporting Water ("Suazo Application"), which adds significantly to the art.

To appreciate the additional advantages of the present invention, it is important to appreciate the significant distances that an interconnected system of liner sections may traverse in a field environment during use and operation of the present invention. Ditch lengths exceeding five thousand feet are not uncommon. In many field environments, the rate at which water flows through a ditch also is significant. Frequently, a ditch master, or similar official, notifies a property owner when water for irrigation has been released upstream. It thereafter becomes the responsibility of the ditch owner to secure the allotment of water before it passes downstream.

It also should be appreciated that loss of water due to cracked, crumbling, and disintegrating concrete lined ditches, commonly referred to as "seepage loss," maybe considerable. Adjacent tree roots also may crack and disintegrate concrete lined ditches.

The present invention seeks to reduce or eliminate water loss associated with concrete lined ditches.

Further optimizations in connection with the Suazo Patent and the Suazo Application may be achieved as provided in connection with the present invention by providing alternative features and elements desirable for increasing the range and variety of differing applications and environments in which the present invention may be used. As indicated, a previously unaddressed need exists for a new, useful and improved ditch liner system that may be installed in concrete lined ditches, particularly a system that is easy to install, lightweight, will transport water efficiently at larger than customary flow rates while also reducing loss of water during conveyance, and will reduce maintenance problems that accompany insiltation, cleaning and maintenance of conventional concrete lined ditches.

SUMMARY OF THE INVENTION

Given the conventional solutions for attempting to solve problems associated with conventional ditch liners, it would be desirable, and of considerable advantage, to provide a ditch liner system for insertion into a concrete lined ditches that is lightweight, easy to install with readily available common tools and equipment, is capable of transporting water efficiently at larger than normal or conventional flow rates, yet significantly reduces water loss during transportation of water through a system of ditch liners. As used in this document, the terms "ditch liner section," "liner section," "liner," and "section" all mean, without limitation, the components described in this document that may be removably connected to form a ditch liner system for transporting water in accordance with the present invention. The terms, therefore, include a ditch liner section and an adapter, as described and claimed in this document. It would also be desirable to provide an apparatus and method for transporting water through a concrete lined ditch that is comparatively less expensive, is aesthetically pleasing in the operative environment, is environmentally friendly, and requires no unique skills to assemble, install, and maintain.

The present invention provides numerous advantages in connection with a ditch liner system for transporting water through a concrete lined ditch. At least one advantage of the present invention is that it provides an apparatus and method for lining ditches that is manufactured and constructed of materials that are environmentally safe, non-toxic, and completely recyclable.

Yet another advantage of the present invention is a unique feature for interconnecting ditch liner sections that allows liner sections to be assembled into a ditch liner system adjacent or beside the ditch before the ditch liner sections are installed in the concrete lined ditch.

Another advantage of the present invention is achieved because a number of ditch liner sections may be assembled into a series of interconnected ditch liner sections for installation into a concrete lined ditch.

Another advantage of the present invention is its ability to transport water efficiently at larger than customary flow rates, while reducing ditch insiltation, cleaning and maintenance, and significantly reducing water loss.

Yet another advantage of the present invention is its capability to withstand climate and temperature changes, as well as puncture shear from domestic and wild animals.

Still another advantage of the present invention is its low cost of installation.

Another advantage of the present invention is its flexible capability to adapt to the contour and configuration of already extant generally meandering concrete lined ditch, and to connect open ends of ditches that might otherwise be unconnectable.

Still another advantage of the present invention is its capability to inexpensively and readily divert flows of water in different directions as needed not only based on the course and courses of interconnected ditches, but also to efficiently deliver the water at the proper place for irrigation.

Another advantage of the present invention is that it provides unique apparatus and methods for interconnecting the sections of the liner system, which also contributes to reducing seepage, flow stoppage and other losses of water at the point of connection or joint between liner sections.

Yet another object of the present invention is that it provides transportable, flexible, and light weight ditch liner system components that can be installed either in existing or newly constructed concrete lined ditches.

Yet another advantage of the ditch liner system is its capability to reroute selected ditch liner sections, and therefore the water that the selected ditch liner sections transport, through a wide range of changes in direction.

Another advantage of the ditch liner system is the capability of diverting water from one ditch into a different ditch.

Still another advantage of the present invention is that the ditch liner system may be used apart from a concrete lined ditch by inverting the customary positioning of the ditch liner system, securing the inverted ditch liner system in place using as a non-exclusive example dirt that covers the inverted ditch liner system, and routing water under the dirt compacted inverted ditch liner system.

Yet another advantage of the present invention is an apparatus and method for directing water that respectively are easy to use and to practice, and cost effective for their intended purposes.

These and other advantages of the present invention are achieved by providing a ditch liner system composed of a plurality of preferably corrugated ditch liners that are removably engageable with each other. Preferably, the ditch liners are manufactured substantially of polyethylene. Each ditch liner section is formed with an upstream and a downstream end. Each ditch liner is substantially trapezoidal in cross-section. The trapezoidal configuration of the cross-section of each ditch liner and ditch liner section is not a limitation of the present invention. Rather, a ditch liner and ditch liner section may be formed in substantially any shape to adapt to the configuration of a concrete lined ditch. A compressibly connectable member is monolithically formed in the downstream end of the plurality of removably engageably ditch liner. In addition, a duct may be peripherally formed in the compressibly connectable member. A coupling sleeve is formed monolithically in the upstream end of the plurality of removably engageable ditch liners. The compressibly connectable member is insertable into the coupling sleeve from the top down. The term "top down" means that the outside surface of the compressibly connectable member may be pressed against the adjoining curved surfaces of the coupling sleeve to connect the compressibly connectable member to the coupling sleeve. A channel also may be peripherally formed in the coupling sleeve. One or more connectors are insertable through the channel into the compressibly connectable member. At least one adapter for directing water from the assembled ditch liner system is provided. In addition, means are provided for connecting the assembled ditch liner system to a concrete lined ditch.

The present invention, therefore, is useful for forming a system for transporting water through a concrete lined ditch that substantially eliminates water loss, is sufficiently lightweight to be easily assembled and placed into a concrete lined ditch, and may be disassembled for relocation, repair, or other purpose, yet remains fixed in the ditch during operation and use.

The foregoing has outlined broadly the more important features of the invention to better understand the detailed description which follows, and to better understand the contribution of the present invention to the art. Before explaining at least one embodiment of the invention in detail, it is to be understood that the invention is not limited in application to the details of construction, to the trapezoidal cross-section configuration, or to the arrangements of the components provided in the following description or drawing figures. The invention is capable of other embodiments, and of being practiced and carried out in various ways. Also, the phraseology and terminology employed in this disclosure are for purpose of description, and should not be regarded as limiting.

It will become apparent to one skilled in the art that the claimed subject matter as a whole, including the structure of the apparatus, and the cooperation of the elements of the apparatus, combine to result in a number of unexpected advantages and utilities that have been noted. The advantages and objects of the present invention, and features of such an apparatus and method for lining a ditch, will become apparent to those skilled in the art when read in conjunction with the accompanying following description, drawing figures, and appended claims.

As those skilled in the art also will appreciate, the conception on which this disclosure is based readily may be used as a basis for designing other structures, methods, and systems for carrying out the purposes of the present invention. The claims, therefore, include such equivalent constructions to the extent the equivalent constructions do not depart from the spirit and scope of the present invention. Further, the abstract associated with this disclosure is neither intended to define the invention, which is measured by the claims, nor intended to be limiting as to the scope of the invention in any way.

The novel features of this invention, and the invention itself, both as to structure and operation, are best understood from the accompanying drawing, considered in connection with the accompanying description of the drawing, in which similar reference characters refer to similar parts, and in which:

DESCRIPTION OF A PREFERRED EMBODIMENT

Briefly, the present invention provides a ditch liner system consisting of substantially corrugated ditch liners having a trapezoidal cross-section. The ditch liner sections are interconnectable, and may further be connected using a sealant and other connectors. Means for anchoring the ditch liner system in a concrete lined ditch are provided. The present invention, therefore, is useful for forming a system for transporting water through a concrete lined ditch that substantially eliminates water loss, is sufficiently lightweight to be easily assembled and inserted into a concrete lined ditch, and may be disassembled for relocation, repair or other purpose.

Figure 1:
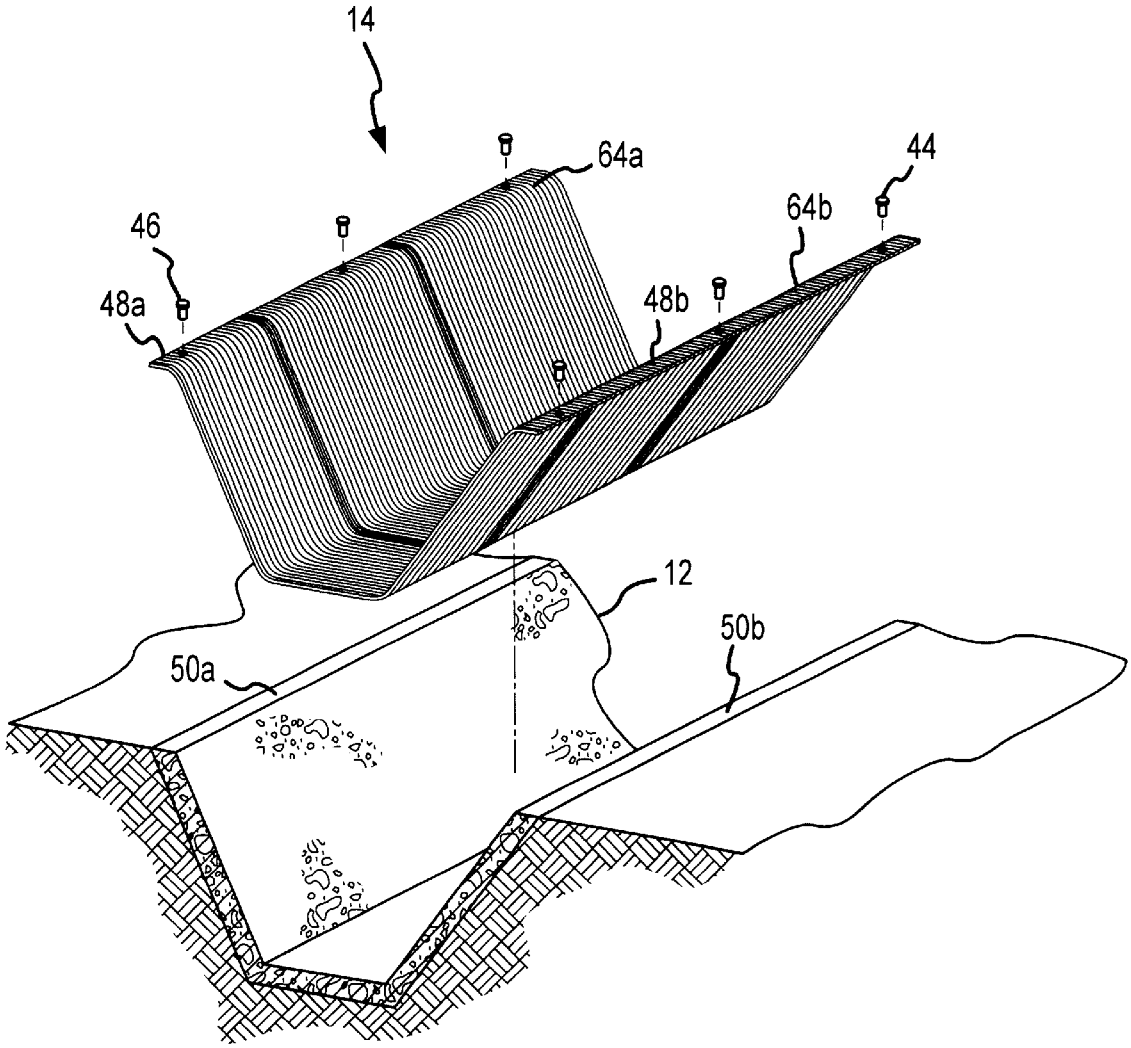
FIG. 1 is a perspective view of the ditch liner system in an operative environment for insertion into a concrete ditch.
Figure 2:
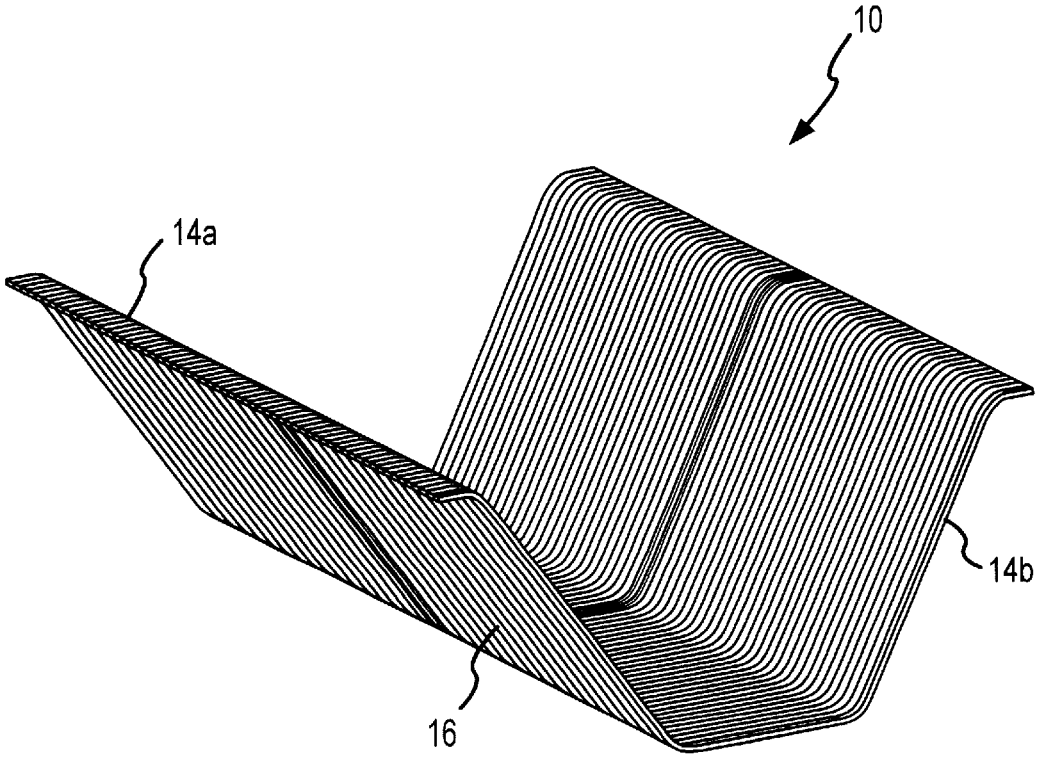
FIG. 2 is a perspective view of two connected ditch liner sections in accordance with the present invention.

Specifically, as shown in FIGS. 1–8B, the ditch liner system 10 is designed for transporting water through a concrete lined ditch 12. As shown in FIGS. 1 and 2, ditch liner system 10 includes a plurality of removably engageable ditch liners 14*a,b*. Ditch liners 14*a,b* of the present invention include a series of interconnected corrugations 16. Ditch liner sections 14*a,b* are substantially trapezoidal in cross-section. As will be evident to one skilled in the art, it will be obvious that the configuration of the trapezoidal cross-section of the preferred embodiment is not a limitation of the present invention. Rather, the cross-section configuration of the present invention maybe configured to adapt to the configuration of any concrete ditch.

Figure 3:
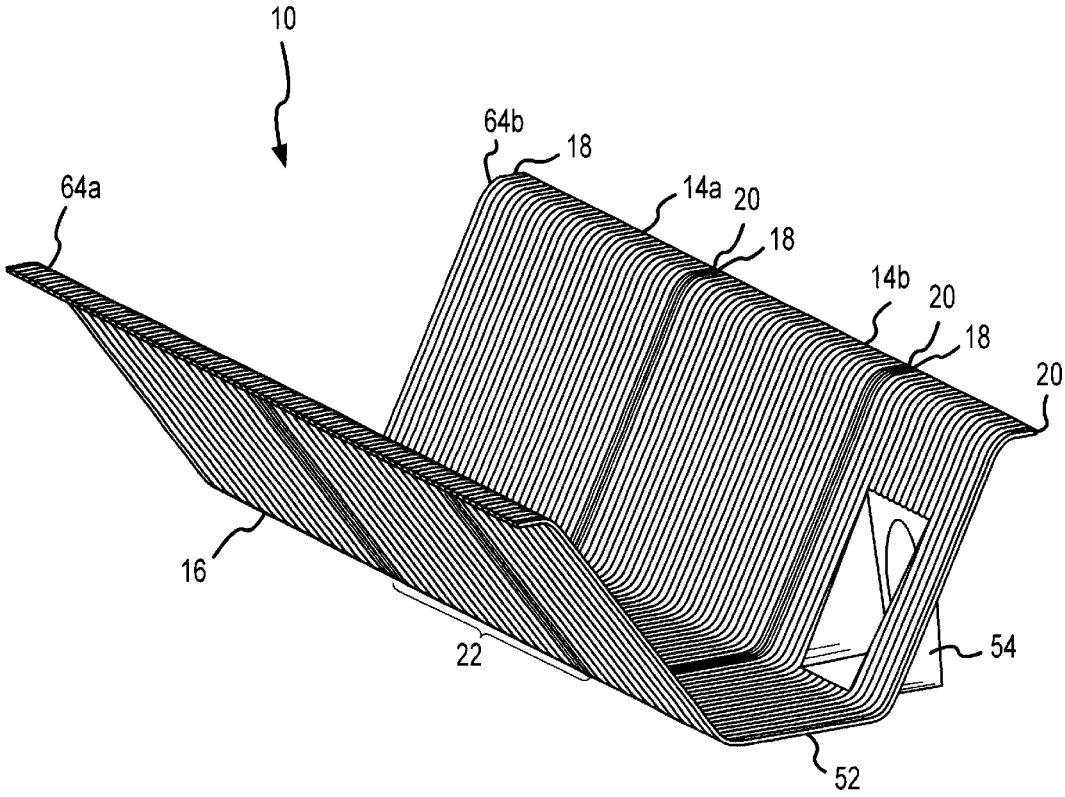
FIG. 3 is a perspective view of two connected ditch liner sections to which an adapter of the present invention has been connected.
Figure 4:
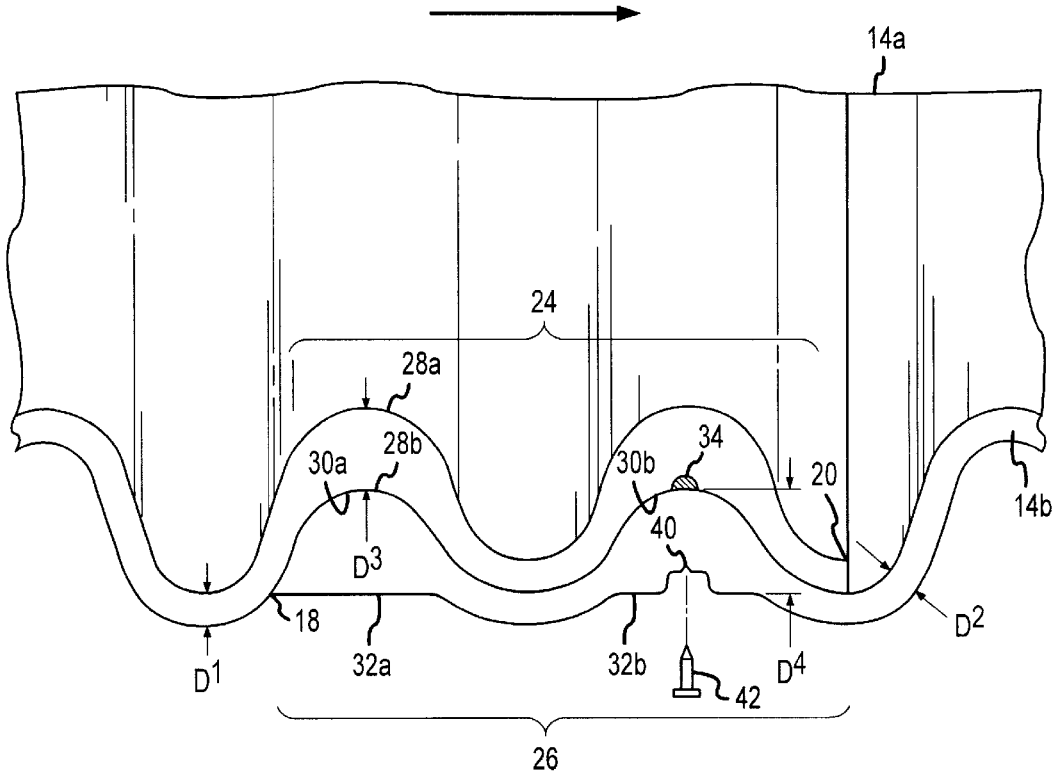
FIG. 4 is a cut-away side view of the compressibly connectable member inserted into the coupling sleeve of the present invention.
Figure 5:
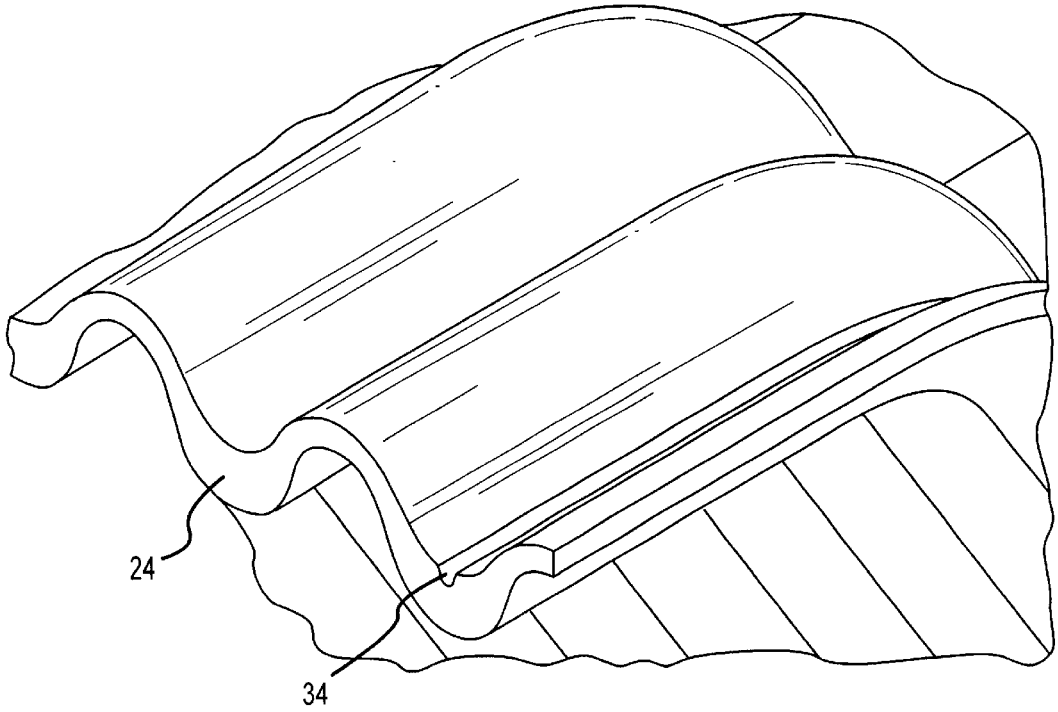
FIG. 5 is a perspective view of the duct peripherally formed in the compressibly connectable member.
Figure 6:
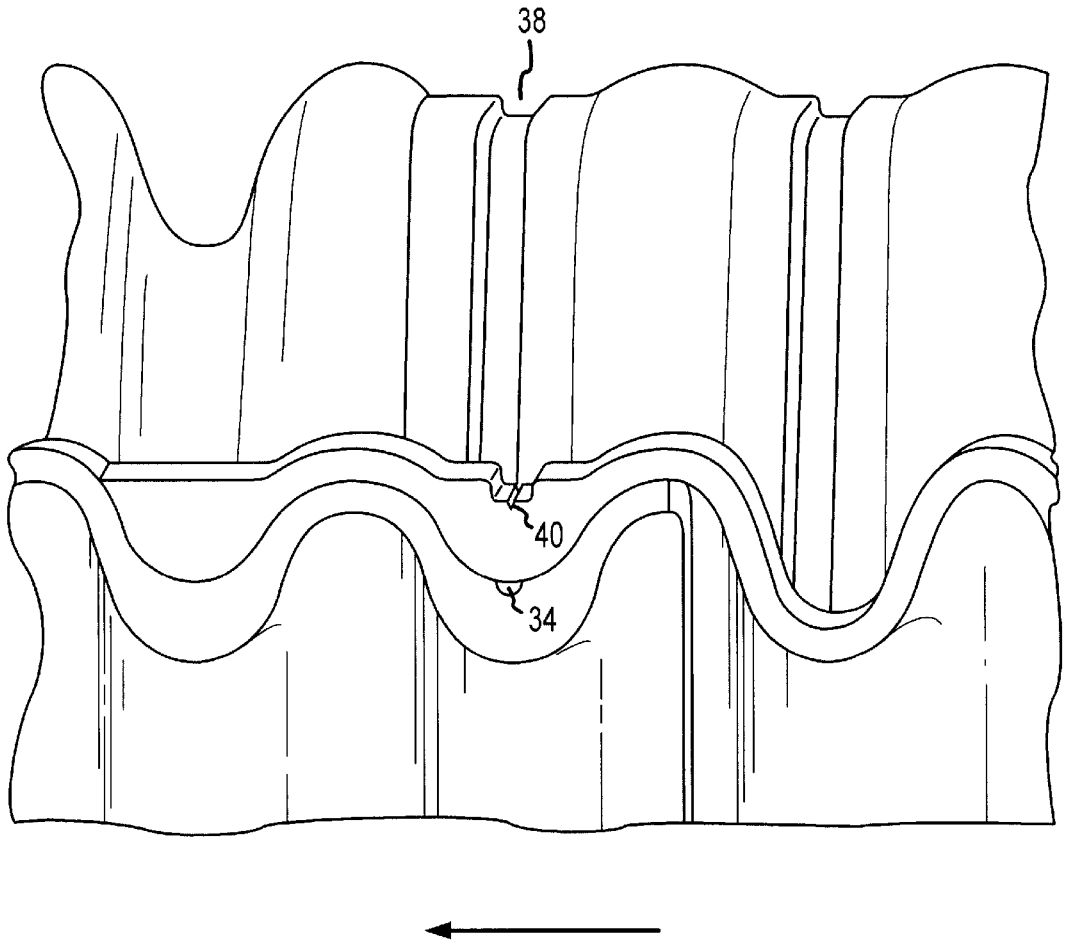
FIG. 6 is a cut-away side view showing both the duct in the compressibly connectable member, and the channel in the coupling sleeve.

As perhaps best shown by cross-reference between FIGS. 3 and 4, each ditch liner section 14*a,b* is formed with an upstream end 18, a downstream end 20, and an intermediate body 22 between upstream end 18 and downstream end 20. As best shown by FIG. 4, compressibly connectable member 24 is monolithically formed in downstream end 20 of each ditch liner section 14*a,b*. A coupling channel 26 is provided. Coupling channel 26 is engageable with compressibly connectable member 24, and is monolithically formed adjacent upstream end 18 of ditch liner sections 14*a* and 14*b*. Both compressibly connectable member 24, and coupling channel 26, are dimensioned to be substantially double the thickness of intermediate body 22 between upstream end 18 and downstream end 20 of each ditch liner section 14*a,b* to add strength to the connected bond between compressibly connectable member 24 and coupling channel 26. As shown diagrammatically in FIG. 4, the cross-section thickness of the series of corrugations 16 adjacent upstream end 18 and downstream end 20, respectively, is shown by comparison between the dimensions $D^1$ and $D^2$. The dimension of compressibly connected member 24 is diagrammatically shown as dimension $D^3$, and the dimension of coupling channel 26 is diagrammatically shown as dimension $D^4$. In addition, both compressibly connectable member 24, and coupling channel 26, are formed to be substantially sinusoidal in cross-section, as also shown in FIG. 4. Compressible connectable member 24, and coupling channel 26, are integrally and monolithically formed in each ditch liner section 14*a,b*. Specifically, compressibly connectable member 24 is monolithically formed in downstream end 20 of each ditch liner section 14*a,b,* and coupling channel 26 is monolithically formed in upstream end 18 of each ditch liner section14*a,b*. Compressibly connectable member 24 includes opposing arched surfaces 28*a,b*. Coupling channel 26, however, is formed with adjoining curved surfaces 30*a,b*. Coupling channel 26 is further formed with substantially planar surfaces 32*a,b* opposite adjoining curved surfaces 30*a,b* of coupling channel 26. As shown by cross-reference between FIGS. 4 and 5, a duct 34 is provided in compressible connectable member 24. Duct 34 is formed peripherally in compressibly connectable member 24. A sealant 36 may be placed in duct 34. Sealant 36 is shown in FIG. 4 as cross-hashed in duct 34. The present invention also includes a groove 38. Groove 38 is formed in coupling channel 26 as shown in FIGS. 4 and 6. Groove 38 extends peripherally around coupling channel 26 as shown by cross-reference in FIGS. 4 and 6. A notch 40 may be formed in groove 38 of coupling channel 26 for guiding insertion of one or more connectors 42 as best shown in FIG. 4. As indicated, one or more connectors 42 is included in the present invention for insertion into groove 38 and into compressibly connectable member 24 for securing and attaching the liner sections 14*a,b*.

The present invention also includes means 44 for anchoring ditch liners 14*a,b* in concrete lined ditch 12. At least one means 44 for anchoring ditch liners 14*a,b* in a concrete lined ditch 12 is a plurality of nails 46, as shown in FIG. 1. Preferably, nails 46 are concrete nails, and are combined with a plurality of washers (not shown). Nails 46 are inserted through opposing lateral fins 48*a,b* formed in ditch liners 14*a,b,* as perhaps best shown in FIG. 1. Nails 46, in combination with the washers (not shown), are inserted through opposing lateral fins 48*a,b* into opposing edges 50*a,b* of concrete lined ditch 12.

Figure 7:
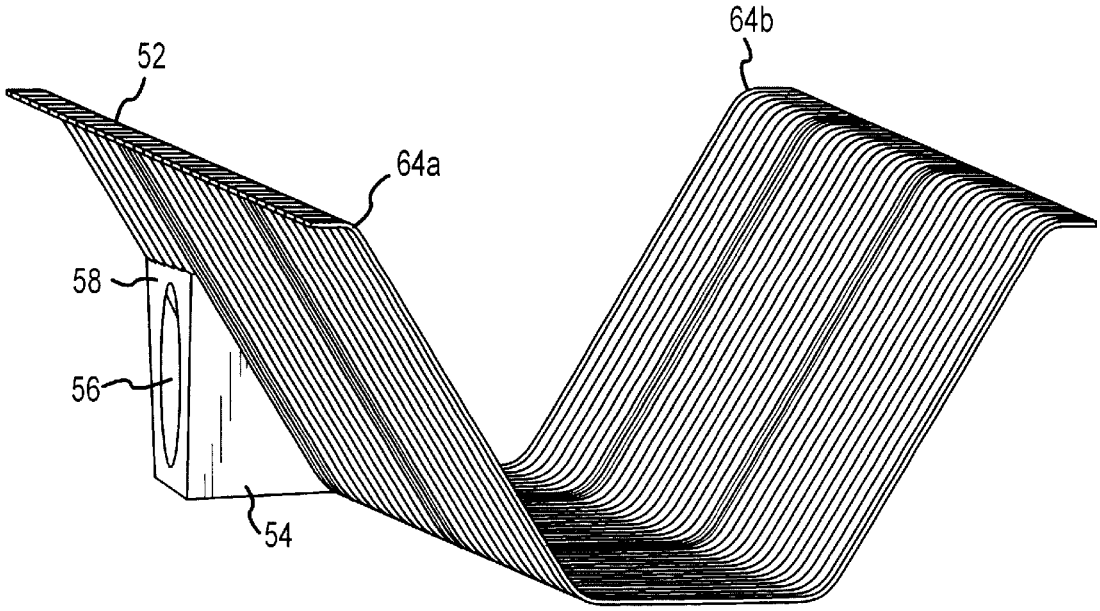
FIG. 7 is a perspective view showing the housing monolithically formed in the adapter.

As shown by cross-reference among FIGS. 3 and 7, the present invention also includes at least one adapter 52. Adapter 52 is formed for directing water from concrete lined ditch 12, or into concrete lined ditch 12. Adapter 52, according to the present invention, includes a housing 54. Housing 54 is preferably monolithically formed in the adapter 52. Housing 54 also is formed with a hole 56 through one wall 58 of housing 54. A hollow pipe 60 is insertable into hole 56 in housing 54. A flange assembly 62 is provided. Flange assembly 62 is mountable on housing 54 for securing hollow pipe 60 in housing 54.

The present invention, therefore, is useful for forming a system for transporting water through a concrete lined ditch, substantially eliminates water seepage, is sufficiently lightweight to be easily assembled and placed into an earthen ditch, and may be disassembled for relocation, repair, or other purpose, yet remains fixed in the ditch during operation and use.

Figure 8A:
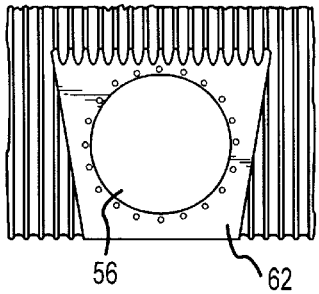
FIG. 8A shows a front view of the flange mounted over the opening of the adapter.
Figure 8B:
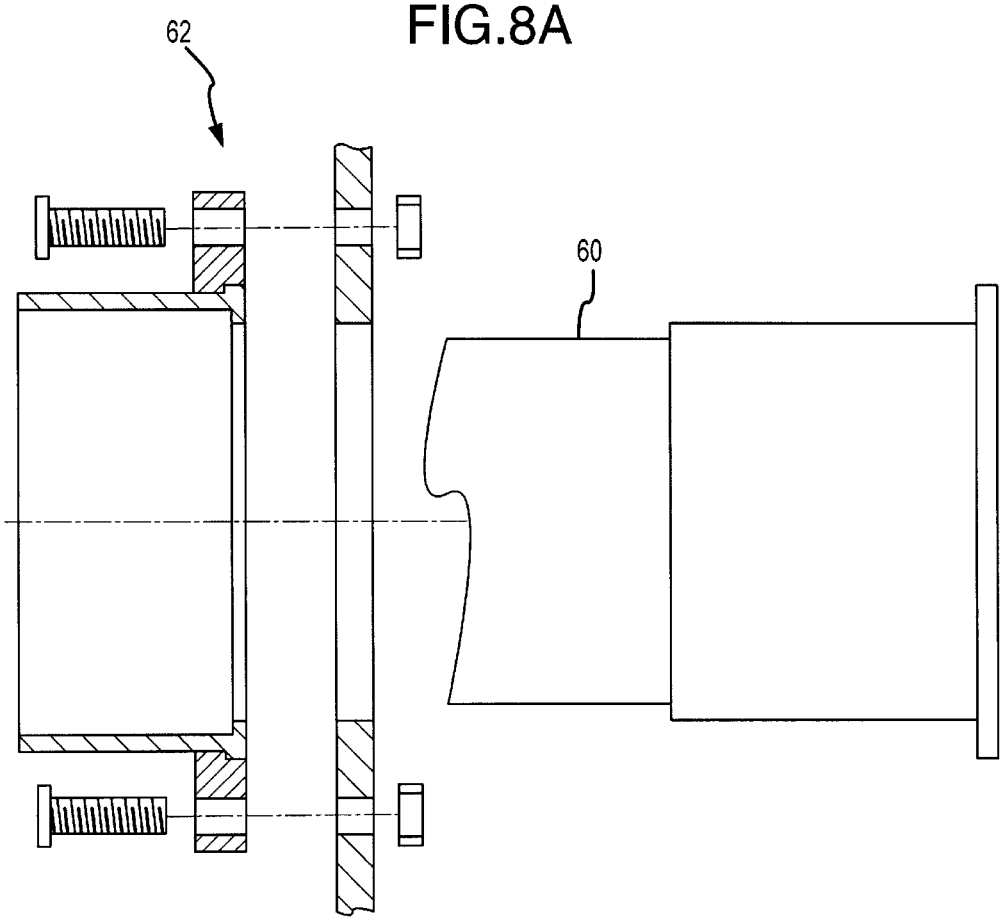
FIG. 8B shows a side cross-section view of the flange, pipe and housing of the present invention.

Although dimensions of liner sections 14*a,b* are not a material consideration in connection with the present invention, in a preferred embodiment of the present invention each liner section 14*a,b* as shown by cross-reference between FIGS. 3,7, and 8B, is formed with a width of 36" between ribs 64 of lateral fins 48*a,b*. The length of each liner section 14*a,b* in a preferred embodiment is 5'6". Corrugations 16 contribute to making each individual liner section 14*a,b* and an interconnected ditch liner system 10, flexible yet at the same time capable of maintaining shape during operation. Corrugations 16 also temporarily trap accumulated sediments for retrieval or ultimate removal. As will be evident to one skilled in the art, the lengths and widths of ditch liners 14*a,b* may be varied during the process of manufacturing to accommodate a wide range of sizes and dimensions of concrete lined ditches 12, in which ditch liners 14*a,b* are deployed. In a preferred embodiment of the present invention, liner sections 14*a,b* are manufactured through molding processes to achieve the monolithic construction of the interrelated elements and components of the present invention.

Also, in a preferred embodiment of the present invention, liner sections 14*a,b* are formed of Medium Density Polyethylene ("MDPE") material. Although material used in the manufacture of one or more liner sections 14*a,b* is not a material consideration or limitation of the present invention, in a preferred embodiment of the present invention liner sections 14*a,b* and related liner sections and components of the system for transporting water through concrete lined ditch 12 are manufactured of medium to high density polyethylene or other thermoplastic materials. At least one advantage of the polyethylene or other thermoplastic materials is that such materials are unpalatable to rodents that otherwise might bore holes through the liner sections 14*a,b*. Yet another advantage of the thermoplastic material is that bum tests indicate the material is highly resistant to heat and fire, a significant advantage given the propensity of property owners to bum rubbish and grasses adjacent ditches. Such materials also contribute to the flexibility, lightness, and environmental usefulness of ditch liner system 10. At least one commercial formulation of the polyethylene is provided by Nova Chemical NOVAPOL™, Serial No. TR-0535-UGhexene MDPE.

The term "corrugated" as used in this document refers to the shape of a liner section 14*a,b* in the form or shape of wrinkles or folds that include alternating ridges and alternating grooves along the longitudinal axis extending the length of liner sections 14*a,b* as best shown by cross-reference between FIGS. 3 and 7.

Sealant 16 is chosen from among sealants that will not bond with material used to construct liner sections 14*a,b*. Sealant 16 therefore permits removable disassembly of one or more liner sections 14*a,b* that have been connected. In operation, tools required for field installation of ditch liner system 10 in accordance with the present invention are common and minimal. Thus, installation may be achieved using only a rubber mallet, a carpenter's hammer, a carpenter's level, a shovel, and a sledge hammer.

Assembly of liner sections 14*a,b* into a ditch liner system 10 for transporting water in concrete lined ditch 12 may be accomplished outside a ditch, lateral or other water transportation system. Assembly along or beside the bank of a ditch allows for easy interconnection of components of ditch liner system 10. In addition, assembly of liner sections 14*a,b* outside a ditch enables inspection of surfaces of concrete lined ditch 12. When interconnected liner sections 14*a,b* are assembled, they may be pulled, stretched and otherwise configured to remove any slack, and to ensure ridged installation as a unit without low spots. A conventional carpenter's level is useful for confirming a reasonable slope. In a preferred embodiment of the present invention, in operation, a slope of 0.50% is recommended.

While the apparatus and method for lining ditches shown in drawing FIGS. 1–8B is one embodiment of the present invention, it is in fact merely one embodiment of the invention, is not intended to be exclusive, and is not a limitation of the present invention. While the particular apparatus and method for lining ditches as shown and disclosed in detail in this instrument is fully capable of obtaining the objects and providing the advantages stated, this disclosure is merely illustrative of the presently preferred embodiments of the invention, and no limitations are intended in connection with the details of construction, design or composition other than as provided and described in the appended claims. Claim elements and steps in this document have been numbered solely as an aid in readability and understanding. The numbering is not intended to, and should not be considered as, intending to indicate the ordering or sequencing of elements and steps in the following claims.

What is claimed is:

1. An apparatus for transporting water through a concrete lined ditch, comprising:

a plurality of removably engageable corrugated ditch liners formed with an upstream end, a downstream end, and an intermediate body therebetween, wherein the plurality of removably engageable corrugated ditch liners is substantially trapezoidal in cross-section;

a compressibly connectable member monolithically formed adjacent the downstream end of the plurality of removably engageable corrugated ditch liners, wherein the compressibly connectable member further comprises a duct peripherally formed in the compressibly connectable member;

a coupling channel engageable with the compressibly connectable member monolithically formed adjacent the upstream end of the plurality of removably engageable corrugated ditch liners;

a groove peripherally formed in the coupling channel;

one or more connectors insertable into the groove and into the compressibly connectable member; and at least one adapter for directing water from the ditch.

2. An apparatus for transporting water through a concrete lined ditch as recited in claim 1, wherein the plurality of removably engageable corrugated ditch liners further comprise means for anchoring the apparatus in the concrete lined ditch.

3. An apparatus for transporting water through a concrete lined ditch as recited in claim 1, wherein the compressibly connectable member is shaped to removably and compressibly engage the coupling channel from the top down.

4. An apparatus for transporting water through a concrete lined ditch as recited in claim 1, wherein the duct is formed for holding a sealant.

5. An apparatus for transporting water through a ditch as recited in claim 1, wherein the groove further comprises a notch for guiding insertion of the one or more connectors.

6. An apparatus for transporting water through a concrete lined ditch as recited in claim 1, wherein the at least one adapter includes a housing monolithically formed in the adapter for directing water from the apparatus.

7. An apparatus for transporting water through a concrete lined ditch as recited in claim 6, further comprising a pipe insertable into the housing.

8. An apparatus for transporting water through a concrete lined ditch as recited in claim 7, wherein the housing further comprises a flange assembly mountable on the housing for securing the pipe in the housing.

9. A ditch liner system, comprising:

a first liner section formed with an upstream end, a downstream end, and an intermediate body therebetween, wherein the first liner section is integrally formed with at least one compressibly connectable member substantially sinusoidal in cross-section and dimensioned to be substantially double the thickness of the intermediate body;

a second liner section couplable to the first liner section, wherein the second liner section is formed with at least one coupling channel; and means for attaching the second liner section to the first liner section.

10. A ditch liner system as recited in claim 9 wherein the at least one compressibly connectable member is formed with opposing arched surfaces.

11. A ditch liner system as recited in claim 10, wherein the second liner section is formed with an upstream end, a downstream end, and an intermediate body therebetween.

12. A ditch liner system as recited in claim 11, wherein the at least one coupling channel is integrally formed in the upstream end of the second liner.

13. A ditch liner system as recited in claim 12, wherein the at least one coupling channel is dimensioned to be substantially double the thickness of the intermediate body.

14. A ditch liner system as recited in claim 13, wherein the at least one coupling channel is substantially sinusoidal in cross-section.

15. A ditch liner system as recited in claim 14, wherein the at least one coupling channel is formed with adjoining curved surfaces.

16. A ditch liner system as recited in claim 15, wherein the at least one coupling channel is formed with substantially planar surfaces opposite the adjoining curved surfaces.

17. A ditch liner system as recited in claim 16, further comprising means for anchoring the ditch liner system to the ditch.

18. A ditch liner system as recited in claim 17, further comprising means for directing water from the ditch liner system.

19. A ditch liner system as recited in claim 18, wherein the cross-section shape of the first liner section and the second liner section is selected from the group of shapes consisting of trapezoids, semi-circles, triangles, squares and rectangles.

20. A method for directing water through a lined ditch, comprising:

selecting a polyethylene material;

molding from the polyethylene material a plurality of substantially trapezoidal corrugated ditch liner sections having an upstream end, a downstream end, an intermediate body between the upstream end and downstream end, and opposing lateral fins;

forming integrally in the downstream end of the plurality of substantially trapezoidal ditch liner sections a compressibly connectable member;

forming integrally in the upstream end of the plurality of substantially trapezoidal ditch liner sections a coupling channel shaped to receptively engage the compressibly connectable member;

configuring the compressibly connectable member with a duct for holding sealant;

disposing a groove in the coupling channel;

providing means for attaching the compressibly connectable member to the coupling channel; and selecting means for anchoring the plurality of substantially trapezoidal ditch liner sections to the lined ditch.

21. A method for directing water through a lined ditch as recited in claim 20, further comprising the substeps of:

including monolithically in the plurality of substantially trapezoidal ditch liner sections an adapter for directing water from the lined ditch;

mounting monolithically on one side of the adapter a housing to compensate for the substantially trapezoidal configuration of the substantially trapezoidal ditch liner sections;

shaping the housing to direct water through the housing from the lined ditch;

inserting a hollow pipe into the housing; and securing the hollow pipe in the housing with a flange.

22. A method for directing water through a lined ditch as recited in claim 20, wherein the compressibly connectable member forming step includes the substeps of:

selecting at least two joined corrugations adjacent the downstream end of the substantially trapezoidal ditch liner sections;

dimensioning the at least two joined corrugations adjacent the downstream end of the substantially trapezoidal ditch liner sections to be substantially double the thickness of intermediate body;

forming in the at least two joined corrugations adjacent the downstream end of the substantially trapezoidal ditch liner sections to be substantially sinusoidal in cross-section; and providing in the compressibly connectable member opposing arched surfaces.

23. A method for directing water through a lined ditch as recited in claim 20, wherein the coupling channel forming step includes the substeps of:

selecting at least two joined corrugations adjacent the upstream end of the substantially trapezoidal ditch liner sections;

dimensioning the at least two joined corrugations adjacent the upstream end of the substantially trapezoidal ditch liner sections to be substantially double the thickness of intermediate body;

forming the at least two joined corrugations adjacent the upstream end of the substantially trapezoidal ditch liner sections to be substantially sinusoidal in cross-section;

configuring the coupling channel to include curved surfaces; and including substantially planar surfaces opposite the curved surfaces.

24. A method for directing water through a lined ditch as recited in claim 20, wherein the groove disposing step includes the substep of depositing a sealant in the duct.

25. A method for directing water through a lined ditch as recited in claim 20, wherein in the attaching means providing step includes the substeps of:

selecting a plurality of self-tapping screws; and inserting the plurality of self-tapping screws through the groove into the compressibly connectable member.

26. A method for directing water through a lined ditch as recited in claim 20, wherein in the anchoring step selecting means includes the substep of inserting one or more nails through the lateral fins into the lined ditch.

* * * * *